US010081025B2

(12) United States Patent
Lin

(10) Patent No.: US 10,081,025 B2
(45) Date of Patent: Sep. 25, 2018

(54) POLE MECHANISM FOR DUAL SHOWER HEADS

(71) Applicant: Xiamen Runner Industrial Corporation, Xiamen (CN)

(72) Inventor: Chun-Hui Lin, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 0 days.

(21) Appl. No.: 15/686,163

(22) Filed: Aug. 25, 2017

(65) Prior Publication Data

US 2018/0117604 A1 May 3, 2018

(30) Foreign Application Priority Data

Nov. 2, 2016 (CN) ..... 2016 2 1168340 U

(51) Int. Cl.

| | |
|---|---|
| ***A47K 3/28*** | (2006.01) |
| ***B05B 1/18*** | (2006.01) |
| ***E03C 1/06*** | (2006.01) |
| ***E03C 1/04*** | (2006.01) |

(52) U.S. Cl.

CPC ..... *B05B 1/185* (2013.01); *E03C 1/0409* (2013.01); *E03C 1/06* (2013.01); *A47K 3/28* (2013.01)

(58) Field of Classification Search

CPC ..... B05B 1/185; E03C 1/0409; E03C 1/06; A47K 3/28

USPC ..... 4/601

See application file for complete search history.

(56) References Cited

U.S. PATENT DOCUMENTS

| | | | | |
|---|---|---|---|---|
| 7,918,424 | B1 * | 4/2011 | Wu | E03C 1/06 239/587.1 |
| 8,191,185 | B2 * | 6/2012 | Tsai | E03C 1/06 239/444 |
| 8,572,771 | B1 * | 11/2013 | Zhadanov | E03C 1/0408 4/615 |
| 2006/0242759 | A1 * | 11/2006 | Tsai | E03C 1/023 4/605 |
| 2008/0169362 | A1 * | 7/2008 | Kwan | E03C 1/06 239/442 |

* cited by examiner

*Primary Examiner* — Huyen Le

(74) *Attorney, Agent, or Firm* — Chun-Ming Shih; HDLS IPR Services

(57) ABSTRACT

A pole mechanism for dual shower head includes a pole and a three-way distributor having one inlet in communication with a water source and two outlets respectively for communication with a first shower head and a second shower head. The pole is securely connected to an outer wall of the three-way distributor and has a socket movably mounted thereon and having a C shaped cutout for holding therein the second shower head.

3 Claims, 7 Drawing Sheets

POLE MECHANISM FOR DUAL SHOWER HEADS

CROSS REFERENCE

This application claims the priority of Chinese Application No. 201621168340.6, filed on Nov. 2, 2016 and the entirety thereof is herein incorporated with reference.

TECHNICAL FIELD

The preferred embodiment of the present invention is related to the field of a pole mechanism and, more particularly, to a pole mechanism for dual shower heads so that damage to the wall of a bathroom for installation of a second shower head is not necessary.

BACKGROUND OF THE INVENTION

Normally, one shower head provided inside the shower room to allow the user to take a shower is a standard equipment in every family. If there is a requirement for a second shower head to adapt to different height of users, damage to the wall of a shower room seems inevitable as this is the standard procedure for installing the shower head. And everyone knows even this is a small construction to the shower room, the inconvenience comes along with the construction is enormous. People will have to endure days not being able to use the shower until the construction is finished.

In order to obviate or mitigate the aforementioned problem, the preferred embodiment of the present invention is to provide a pole mechanism for dual shower heads to allow the user to have a second set of shower head without the need to damage the shower room wall.

SUMMARY OF THE INVENTION

It is an objective of the preferred embodiment of the present invention to provide a pole mechanism having a pole and a three-way distributor with one inlet in communication with water source and two outlets respectively in communication with a first shower head and a second shower head. The pole is securely connected to an outer wall of the three-way distributor and has a socket movably mounted thereon and having a C shaped cutout for holding therein the second shower head.

Still another objective of the preferred embodiment of the present invention is that the three-way distributor has a hollow casing provided with an inlet and two outlets, a three-way valve respectively communicating with the inlet and the two outlets of the casing, a core one end of which extends out of the casing and the other end of which is received inside the three-way valve, a seal respectively provided at two channels, communicating with the two outlets of the casing, of the three-way valve so that when the core rotates, one end of the core inside the three-way valve stops one of the two channels or located at a location between the two channels.

A further objective of the preferred embodiment of the present invention is that a knob is provided at a front end of the casing to control rotation of the core.

Still, a further objective of the preferred embodiment of the present invention is that a cover is provided to a rear end of the casing and has a connector mounted on an outer wall of the cover to connect to the pole. A rotation device is provided at a joint between the casing and the cover and a joint between the cover and the connector and composed of a top teethed disk mounted on the casing, a bottom teethed disk mounted on the cover, a spring abutted against a side face of the bottom teethed disk to maintain engagement between the top teethed disk and the bottom teethed disk. A connecting rod is provided respectively to the casing and the cover to allow the casing and the cover to rotate around the connecting rod. The spring is provided respectively to the cover and the connector.

A further objective of the preferred embodiment of the present invention is that a cap is provided to a rear end of the cover.

Compared with the conventional technique, it is noted that the objectives of the preferred embodiment of the present invention has the following advantages: the three-way distributor has the connector to connect to the pole, which is simple in structure, beautiful in appearance, easy for installation/disassembly, inexpensive and avoids the damage to the shower room when a second shower head is required.

DETAILED DESCRIPTION OF THE PREFERRED EMBODIMENT

Figure 1:
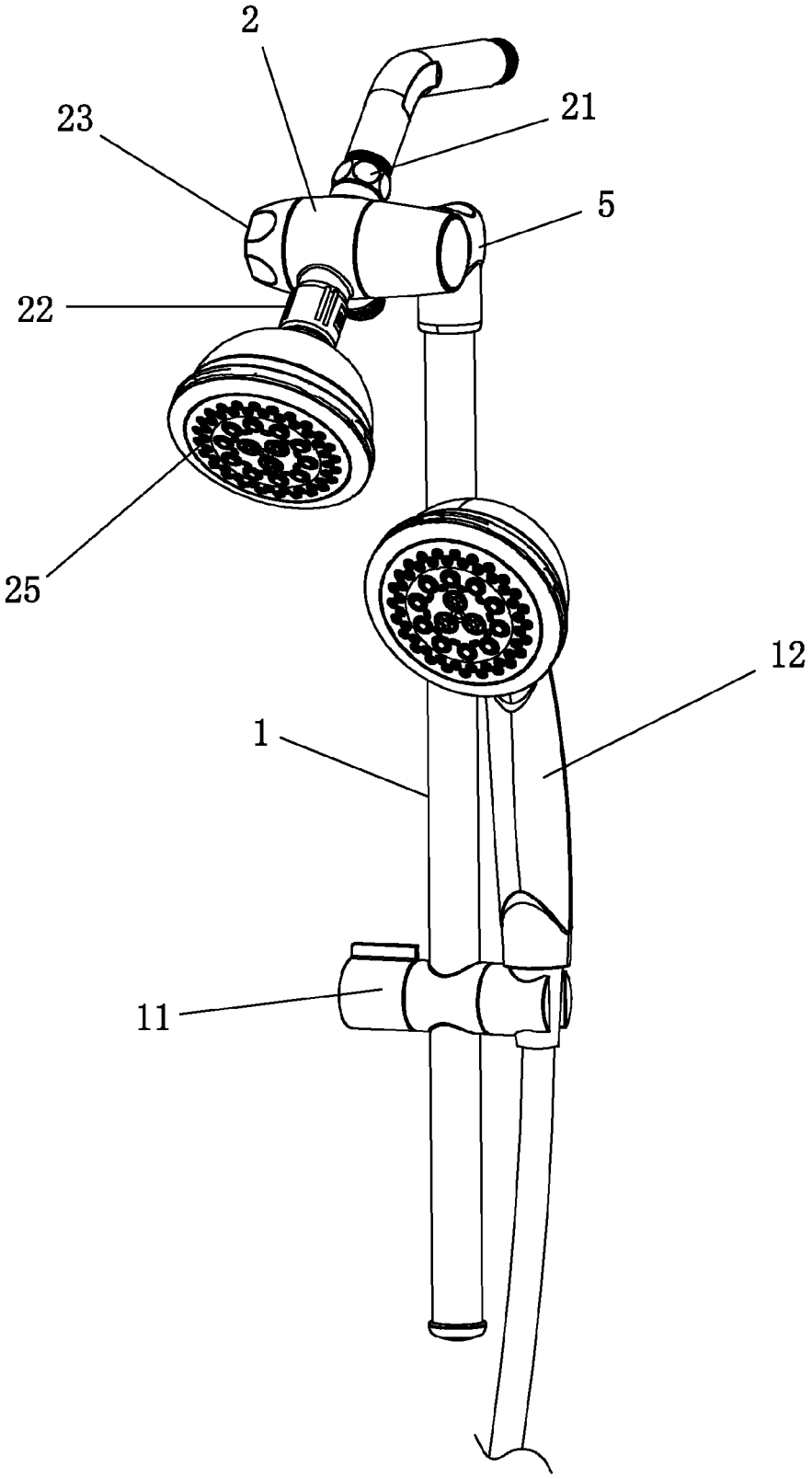
FIG. 1 is a perspective view of the pole mechanism adapted for holding two shower heads and constructed in accordance with the preferred embodiment of the present invention.
Figure 2:
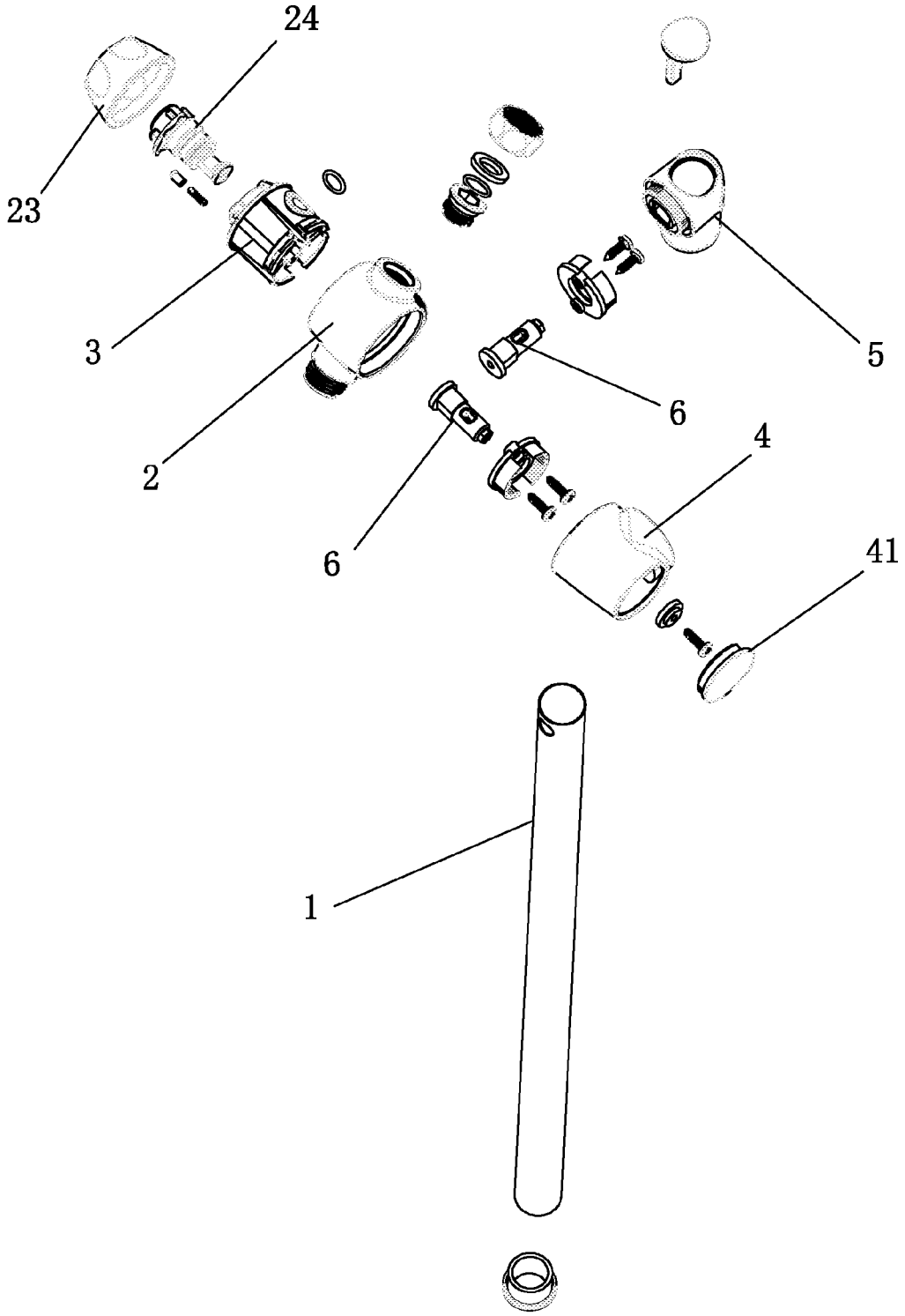
FIG. 2 is an exploded perspective view of pole mechanism shown in FIG. 1.
Figure 3:
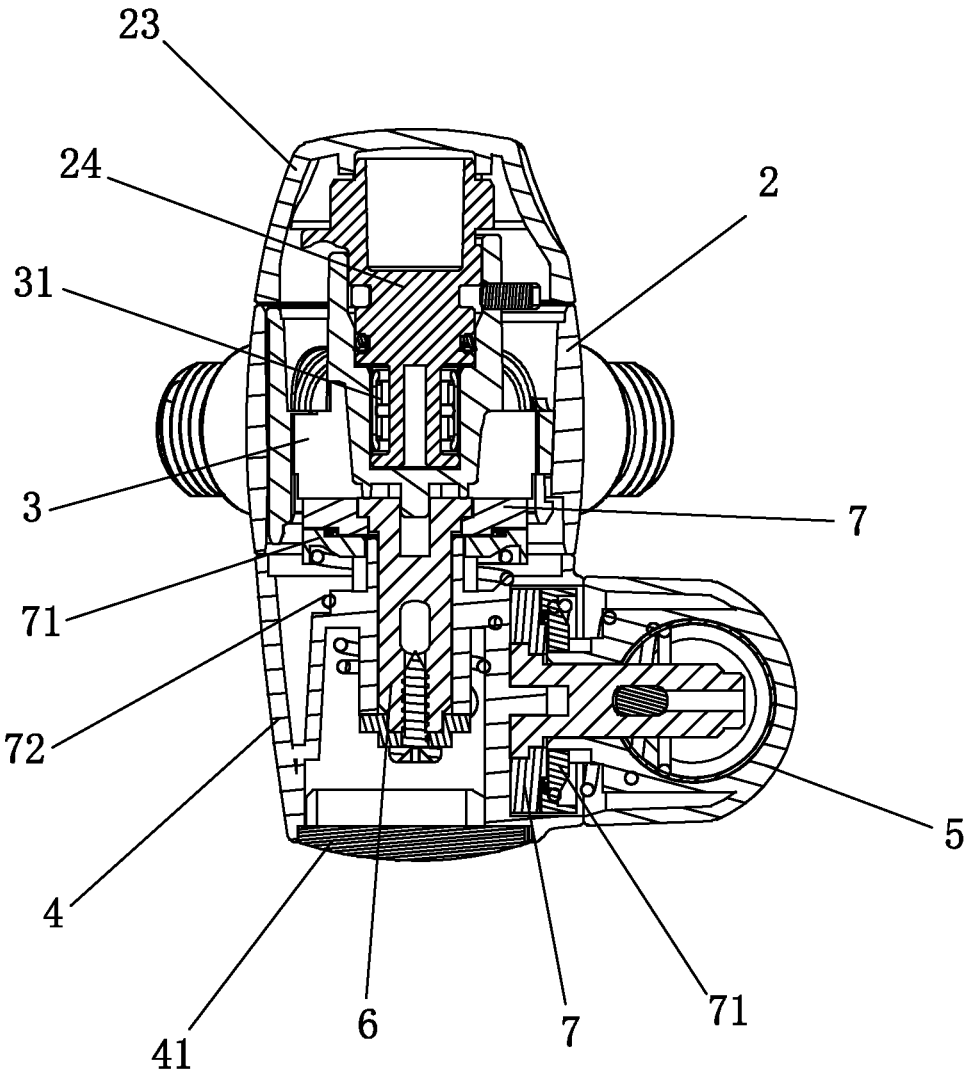
FIG. 3 is an cross sectional view of the three-way distributor of the preferred embodiment of the present invention.
Figure 4:
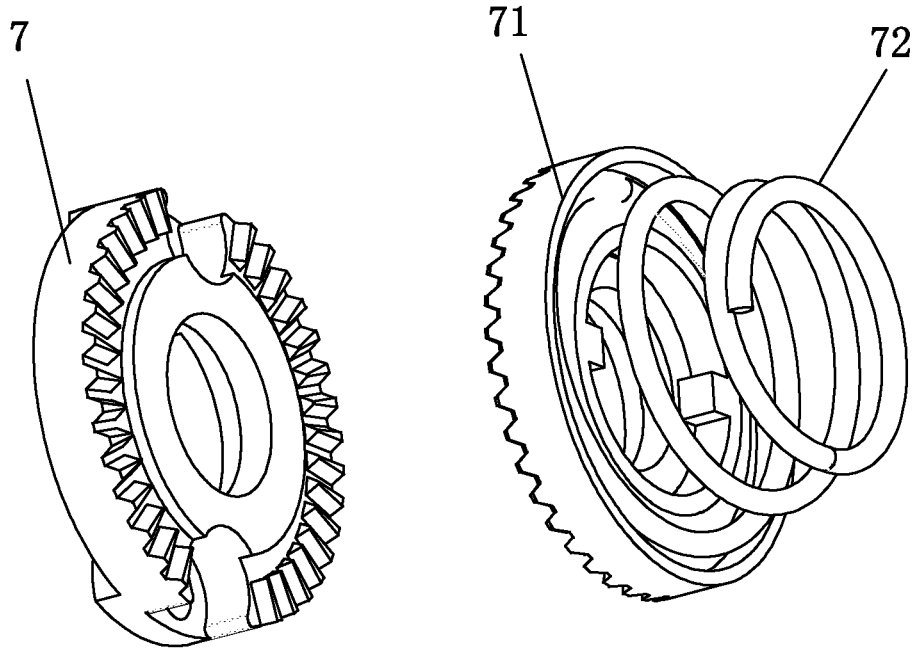
FIG. 4 is an exploded perspective view of the rotation device of the preferred embodiment of the present invention.

Preferred embodiment(s) of the present invention in combination with the attached drawings shall be provided in detail in the following description. However, the given description is for example purpose only and should not be deemed as a limiting to the scope of the present invention in any way.

In order to make it easy to carry out the preferred embodiment of the present invention, a detailed description of the parts of the invention, supported with figures is provided here. As each part of the preferred embodiment of the present invention has many features, it is made easy to read, by referring to each feature with a number included in the parts description text. The number of the parts feature(s) is indicated here by starting it sequentially from the number 1, wherever a part feature appears in a text, an associated serial number is directly assigned.

With reference to FIGS. 1 to 7, a pole mechanism constructed in accordance with referred embodiment of the present invention includes a pole 1, a casing 2, a three-way distributor 3, a cover 4, a connector 5, a connecting rod 6 and a rotation device composed of a top teethed disk 7, a bottom teethed disk 71 and a spring 72.

The pole mechanism includes a pole 1, a three-way distributor with the pole securely attached thereto and having an inlet 21 for communication with a water source and two outlets 22 respectively communicating with a first shower head 25 and a second shower head 12. A socket 11 is movably mounted around the pole 1 and has a C shaped cutout defined for holding therein the second shower head 12.

The three-way distributor is composed of a casing 2, a three-way valve 3 received inside the casing 2 and provided with one inlet and two outlets respectively in communication with the inlet 21 and outlets 22 of the three-way distributor and a core 24 a front end of which extends out of the casing 2 and a rear end of which is received inside the three-way valve 3. At a joint where each outlet of the three-way valve 3 connects to a corresponding one of the two outlets 22 of the three-way distributor a seal 31 is provided so that when the core 24 is rotated, the rear end of the core 24 is either blocks the communication between the mutually corresponding outlets of the three-way distributor and of the three-way valve 3 or located in-between. A knob 23 is provided to one end of the casing 2 to control the rotation of the core 24.

A cover 4 is provided to the other end of the casing 2 and has a connector 5 provided to an outer periphery thereof to connect to the body of the pole 1. At a joint where the casing 2 connects to the cover 4 and the cover 4 connects to the connector 5, a rotation device is provided and includes a top teethed disk 7 respectively mounted onto an inner side face of the casing 2 and the cover 4, a bottom teethed disk 71 and a spring 72 one end of which is securely abutted against an inner wall of the cover 4 and the connector 5 and the other end of which is securely abutted against a side wall of the bottom teethed disk 71 to maintain engagement between the top teethed disk 7 and the bottom teethed disk 71. A connecting rod 6 is respectively provided to the casing 2 and the cover 4 to allow the cover 4 and the connector 5 to be rotatable around the connecting rod 6. A cap 41 is provided to a rear end of the cover 4.

Figure 5:
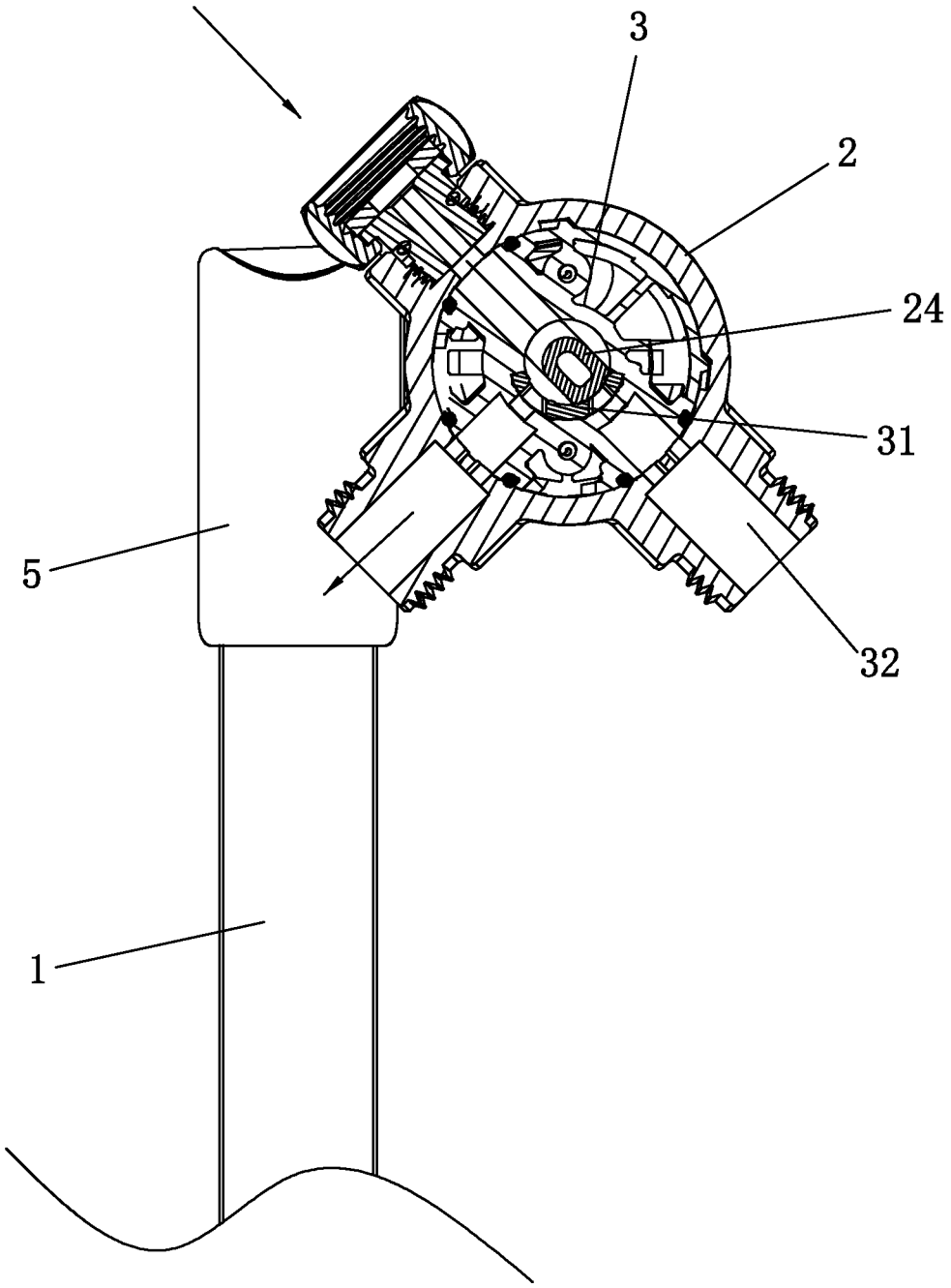
FIG. 5 is a schematic cross-sectional view showing the water outflow in the three-way distributor of the preferred embodiment of the present invention.
Figure 6:
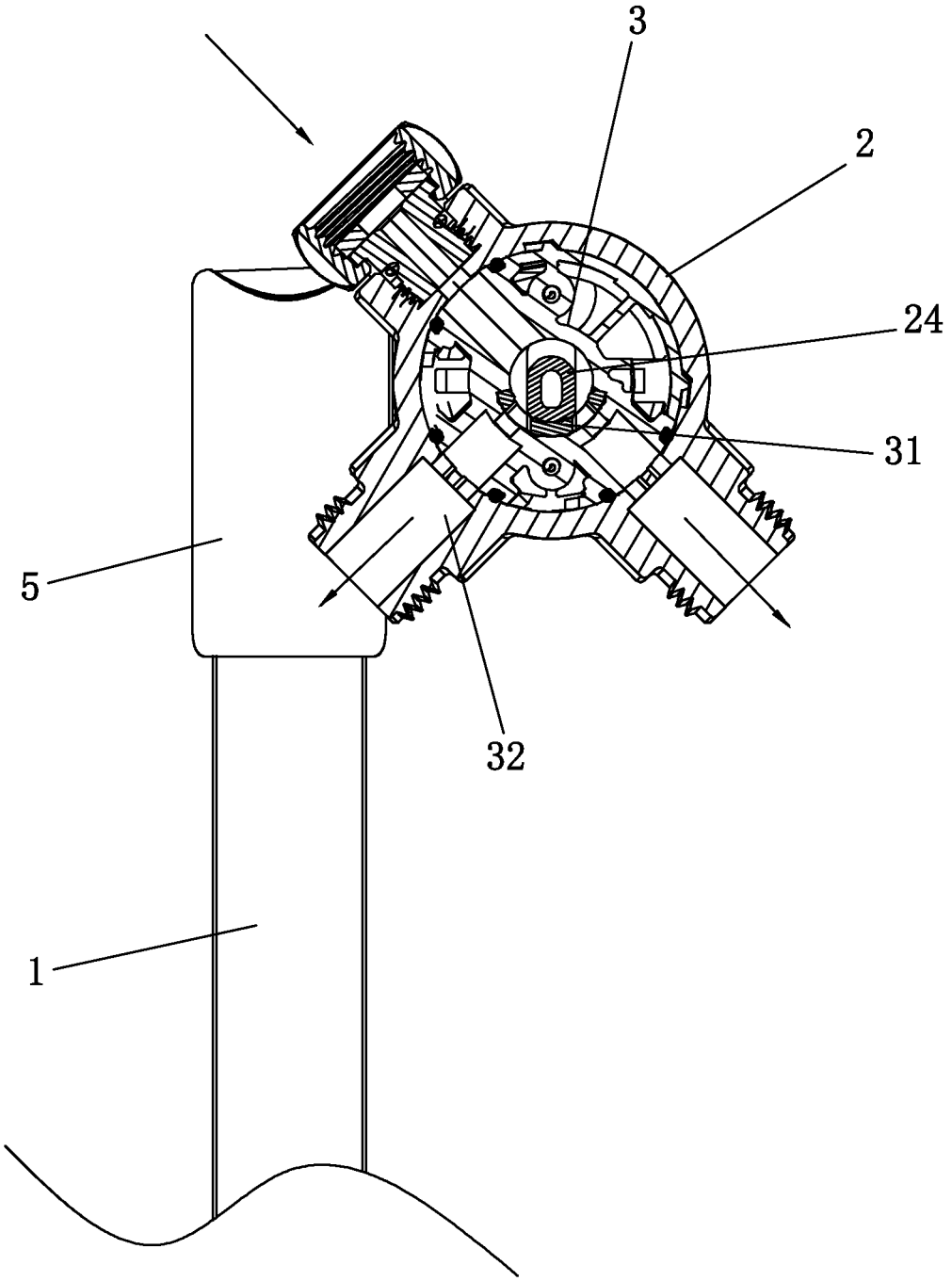
FIG. 6 is still a schematic cross-sectional view showing the water outflow in the three-way distributor in a different mode of the preferred embodiment of the present invention.
Figure 7:
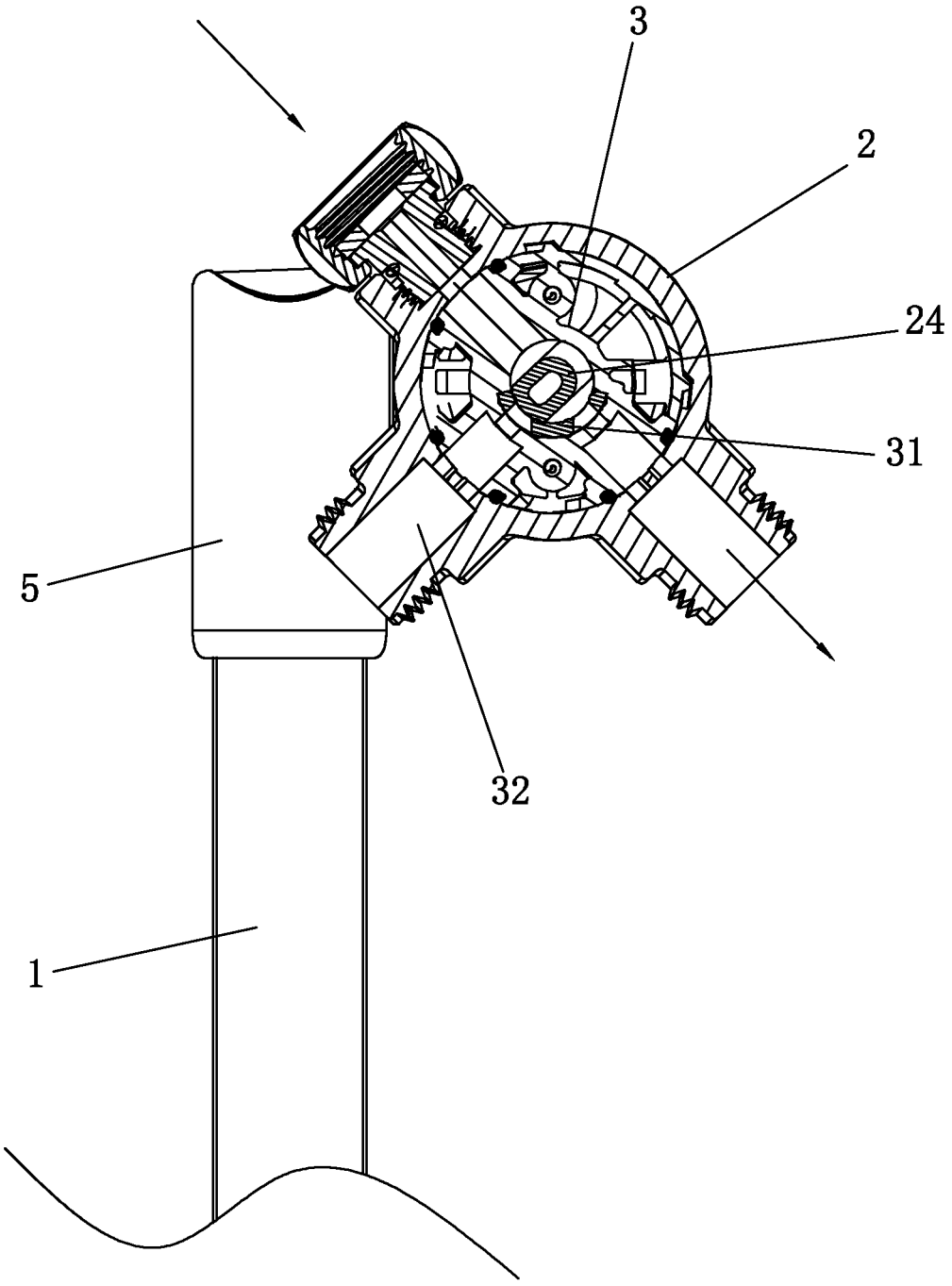
FIG. 7 is a further cross-sectional view showing the water outflow in the three-way distributor in a mode different from those in FIGS. 5 and 6.

With reference to FIGS. 5-7, by way of the control from the knob 23, the rotation of the core 24 is able to block different outlets to function the first shower head 25 and/or the second shower head 12.

Combining the three-way distributor and the pole 1 allows the operator to mount the three-way distributor onto the pipe on the wall. With the control of the knob 23, the first shower head 25 and/or the second shower head 12 are able to function simultaneously or independently.

After a detailed description of the preferred embodiment(s) has been provided, any skilled person in the art would easily understand the description so provided is for example purpose only. The scope for protection of the present invention is defined by the attached claims. Any skilled person in the art would easily amend, modify or alter the elements/devices of the present invention without departing from the principle essence and spirit of the present invention. However, the amendment, modification or alteration shall fall within the protection scope sought of the present invention.

What is claimed is:

1. A pole mechanism for dual shower head, the pole mechanism having a pole and a three-way distributor, wherein the improvements comprise:

the three-way distributor having one inlet in communication with a water source and two outlets respectively for communication with a first shower head and a second shower head, the pole being securely connected to an outer wall of the three-way distributor and having a socket movably mounted thereon and having a C shaped cutout for holding therein the second shower head, wherein the three-way distributor has a hollow casing provided with an inlet and two outlets, a three-way valve respectively communicating with the inlet and the two outlets of the casing, a core one end of which extends out of the casing and the other end of which is received inside the three-way valve, a seal respectively provided at joints where the three-way valve connects to the two outlets of the casing so that when the core rotates, one end of the core inside the three-way valve stops one of the two outlets or located at a location between the two outlets;

wherein a cover is provided to a rear end of the casing and has a connector mounted on an outer wall of the cover to connect to the pole, a rotation device is provided at a joint between the casing and the cover and a joint between the cover and the connector and composed of a top teethed disk mounted on the casing, a bottom teethed disk mounted on the cover, a spring one end of which is abutted against a side face of the bottom teethed disk to maintain engagement between the top teethed disk and the bottom teethed disk and the other end of which is securely attached to a side face of the cover and the connector, and a connecting rod is provided respectively to the casing and the cover to allow the casing and the cover to rotate around the connecting rod.

2. The pole mechanism as claimed in claim 1, wherein a knob is provided at a front end of the casing to control rotation of the core.

3. The pole mechanism as claimed in claim 1, wherein a cap is provided to a rear end of the cover.

* * * * *